United States Patent [19]

Ramney

[11] 4,140,317

[45] Feb. 20, 1979

[54] CONTAINERIZED GREETING CARD AND GAME TOY

[76] Inventor: Tiberius J. Ramney, 480 Iron Bridge Rd., Freehold Township, Monmouth County, N.J. 07728

[21] Appl. No.: 795,746

[22] Filed: May 11, 1977

[51] Int. Cl.[2] ..... A63B 63/00; B65D 75/54

[52] U.S. Cl. ..... 273/102 R; 46/1 L; 46/11; 229/72; 229/75; 273/157 R; 273/287

[58] Field of Search ..... 273/95 R, 102 R, 102 PM, 273/157 R; 46/1 L, 11, 35; 229/71, 72, 75

[56] References Cited

U.S. PATENT DOCUMENTS

| | | | |
|---|---|---|---|
| 500,996 | 7/1893 | Cutter | 229/72 |
| 1,601,318 | 9/1926 | Overly | 229/72 |
| 1,706,300 | 3/1929 | Kakaley | 229/72 |
| 1,976,321 | 10/1934 | Benedict | 229/72 |
| 2,010,830 | 8/1935 | Staudte | 273/157 R X |
| 2,224,607 | 12/1940 | Petzold | 229/72 |

*Primary Examiner*—William H. Grieb

[57] ABSTRACT

A containerized greeting card and game toy combination, constructed of cardboard, plastic or similar material, made up of several sections forming panels and flaps foldable along folding lines into a flat container and secured in folded position by a closing device.

On the interior surface of one or several panels is a laminated thin frame interrupted at the folding lines, surrounding a puzzle or board-game. One or several panels or flaps are provided with pockets for the storage of the components making the puzzle or the game.

On the exterior surfaces of the foldable panels and flaps are printed, according to the location, the greeting card text, the instructions and contents of the game, advertising and the post-card form for mailing the contained card game.

2 Claims, 9 Drawing Figures

CONTAINERIZED GREETING CARD AND GAME TOY

BACKGROUND OF THE INVENTION

It is an old custom to give or to exchange gifts on such occasions as Christmas and religious holydays, anniversaries, graduations, hospitalizations, etc., the gifts generally being handed or mailed with a greeting card selected for the occasion.

On some occasions, such as birthdays for children parties are being held, and the guests, friends and relatives bring inexpensive gifts such as balloons, small games or books and a birthday greeting card with each gift.

On any such occasions, novelty greeting cards in the form of three dimensional foldable cards, pop-up or animated cards have been long known to be used to combine the greeting card and a small toy in a single item.

Books, coloring posters, records and other novelty items having imprinted birthday greetings and mailing instructions have also been long known to be used for the same purposes.

The above and other prior art devices have failed to produce a functional combination of a greeting card and a game or toy within a foldable container adaptable to a variety of games or puzzles, educational or informative subjects, such contained card-games being suitable for mailing without any additional envelope or packaging, or suitable of being carried without the use of a box or container, and offering the advantages of any board game or puzzle, simple in construction and attractive in appearance.

The present invention presents an alternative to the occasional purchase of a gift "and" of an accompanying greeting card, combining in a single and convenient flat container a greeting card and a board or novelty item, self packaged, portable and mailable.

SUMMARY OF THE INVENTION

The present invention comprises a flat sheet of cardboard or plastic material, foldable along bend lines or creases to form, when folded, a rectangular, triangular, hexagonal, or other geometrically shaped envelope-like container. On the interior of one or several folds of the centrally located panels is printed a board game, puzzle, or other novelty, amusement or educational subject, surrounded by a laminated or pre-formed frame, made of like material. On the interior of one or several folds are glued or laminated pockets for the storage of the components making the game or the puzzle.

On the exterior surfaces of various folds, according to the location when in folded position, are printed the text of the greetings, instructions for playing the game, the description of the contents, advertising and the printed post-card form for mailing the card.

The various foldable panels and flaps are closing in sequence to form an enclosure, the folds being held in place with a butterfly type fastener or similar device.

Thus it is the object of this invention to provide a new and original greeting card and game toy combination which can be folded in the form of a flat container and mailable like an ordinary greeting card.

It is yet another object of this invention to provide a combination greeting card and game toy suitable for a large variety of games, puzzles, educational, informative or amusement subjects, the subject-game being printed on the interior surface of the foldable panels & flaps, and surrounded by a raised frame, having the playing components stored in pockets glued or laminated at convenient locations on the foldable panels, and having printed on the exterior surfaces of various panels and flaps, instructions for the subject games, greetings, advertizing and the post-card form for mailing, the cardboard folding as to enclose the contents in the form of a container and locked with a fastener, in folded condition.

It is yet another object of this invention to create a greeting card and game toy which is mailable without the use of an envelope or any additional packaging, easy to fold and unfold and to be used when needed for play or amusement, and having all loose components stored in a pocket within the enclosure.

DETAILED DESCRIPTION OF THE INVENTION

Figure 1:
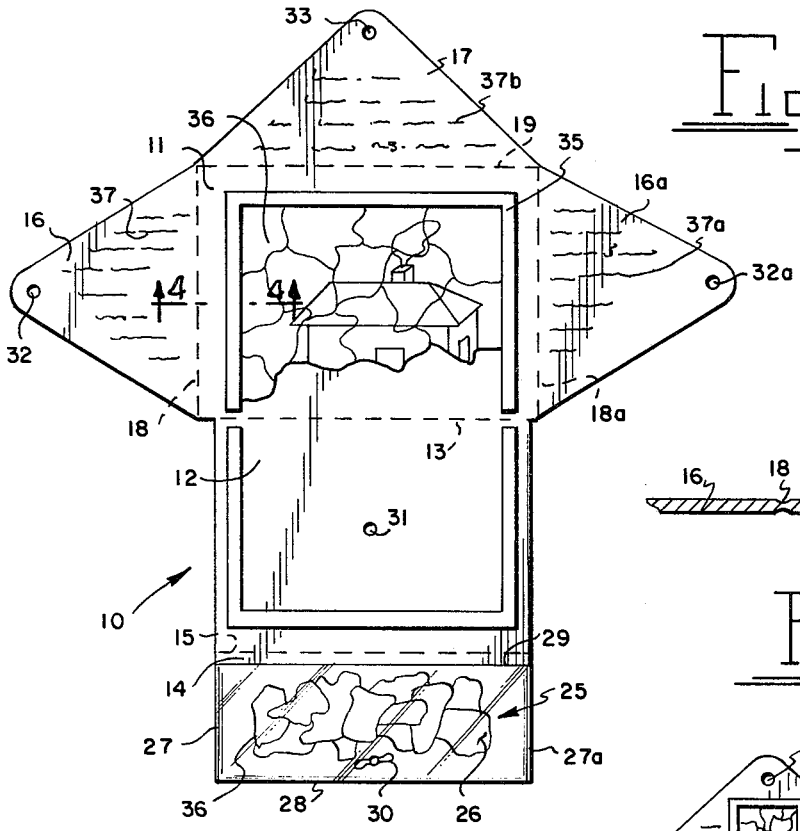
FIG. 1 is a plan view of the interior surface of my invention, in flat position, game components partially in place.
Figure 4:
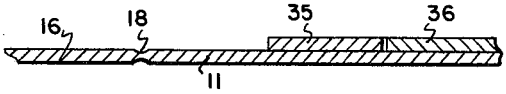
FIG. 4 is a cross-sectional view through the line 4—4 of figure one.

Refering more in detail to the drawings, aprefered embodyment of the present invention exhibits a novelty greeting card formed of cardboard or similar paper or plastic structure sheet 10, molded or cut in the form of a single integrated unitary sheet member, however being characterized by a plurality of crease bendable fold lines which permit various sections of the card to be folded in a certain manner to form an envelope-like container.

The sheet 10 comprises a central rectangular panel 11, a rectangular middle panel 12 separated at the bottom of the front panel 11 by the crease or fold line 13, and a rectangular end panel 14, separated at the bottom of the middle panel 12 by the crease or fold line 15.

Figure 2:
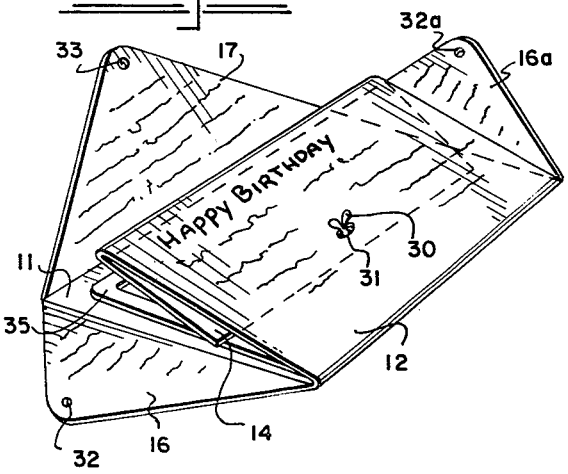
FIG. 2 is a plan view of the exterior surface of FIG. 1 in flat position.

The central rectangular panel 11 is about the size of a large greeting card page. The middle rectangular panel 12 is slightly smaller in width and hight than the central panel 11, and the end panel 14 is of the same width as the middle panel 12 but is still smaller in hight, as shown in FIGS. 1 and 2.

On the lateral sides of the central panel 11 are two integral flaps, one on each side, as indicated at 16 and 16a and at the top of the front panel 11 is the integral flap 17, the three flaps being generally triangular in shape, and foldable over the central panel 11 along the fold lines respectively indicated at 18, 18a and 19.

The bases of the triangular flaps 16, 16a and 17 are of the same length as the adjacent sides of the central panel 11 and the adjacent folding line, however the height of each flap exceeds in length the location of the imaginary geometrical center of panel 11 when the flaps are folded, like the flaps of any regular envelope, so that when folded in sequence, the apex of the flaps will overlap over the geometrical center of panel 11.

Figure 3:
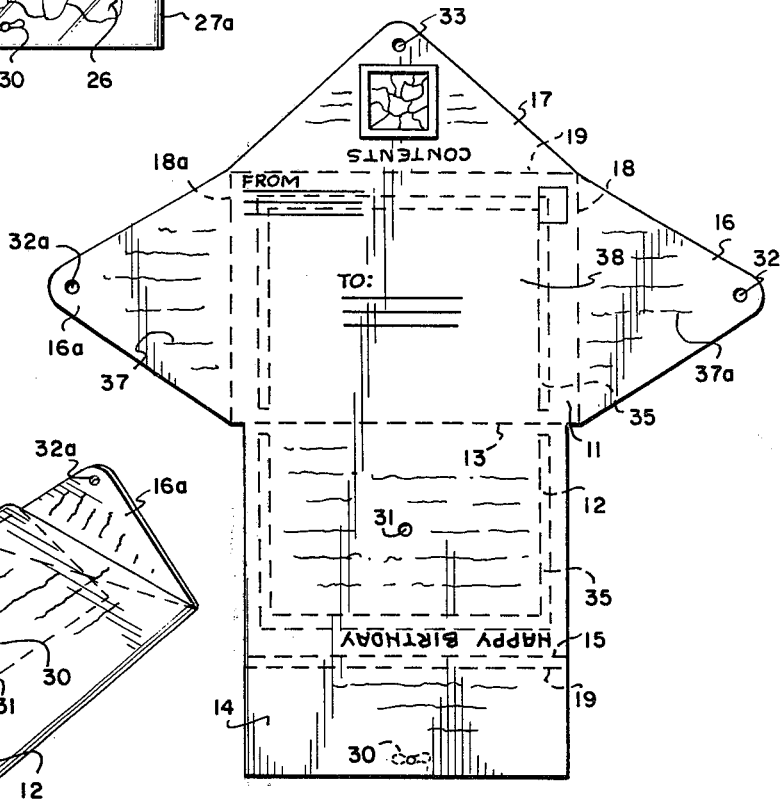
FIG. 3 is a perspective view of the first embodiment of my invention showing the folding sequence.

The end panel 14 is provided with a pocket 25, made of a flat sheet of clear plastic or similar material 26, having the same width as the end panel 14 but slightly smaller in hight, and laminated on the side edges 27 and 27a and the bottom edge 28 to the interior surface of panel 14, thus having the pocket's opening 29 just below the folding line 15, so that the panel 14 with the pocket 25 will fold easily along the folding line 15 over the middle panel 12, as shown in FIG. 3.

All foldable sections of the flat sheet 10 comprising the greeting card of present invention are to be folded in sequence: the packet panel 14 over the middle panel 12, then both panels over the central panel 11, over which are then folded in sequence the sides triangular flaps 16 and 16a, and last the top flap 17, as shown in FIG. 3.

To further facilitate the description of the present invention, it is essential to explain that, when in folded position, all panels and tabs described above are overlaping over the imaginary geometrical center point of central panel 11, so that an imaginary axis perpendicular to the panel 11 at its geometrical center point will pierce all other panels and flaps at some imaginary place we will designate as the "axis point". Thus, when in unfolded position, the axis point of panel 11 is at its geometrical center; the axis point of middle panel 12 is slightly below its geometrical center; the axis point of the pocket panel 14 is near the bottom edge of the panel, and the axis point of each of the three flaps 16, 16a and 17 are near the apex of each flap.

At the axis point of the end pocket panel 14, fastened to the clear plastic sheet 26 forming the pocket 25 is a metal closing device 30 of the butterfly type, generally as used for closure on most large manilla envelopes.

At its "axis point", the middle panel 12 is provided with a hole 31 of a diameter matching the raised wings of the butterfly fastener 30, so that folding the pocket panel 14 over the middle panel 12, the raised wings of the butterfly fastener will pass through the hole 31, and then both panels will fold over the central panel 11.

Figure 6:
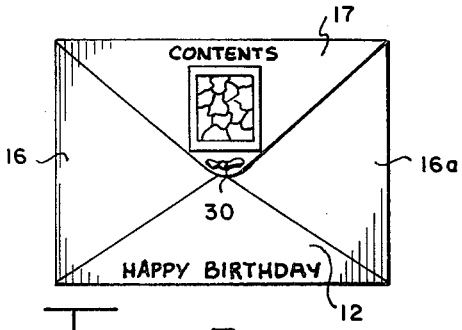
FIG. 6 is the back plan view of FIG. 5.

Further, each of the triangular flaps 16, 16a and 17, is provided with a similar hole at its axis point as indicated respectively at 32, 32a and 33, so that when folded in sequence over the folded panels 14 and 12, the said flaps will complete the envelope-like container, the wings of the butterfly fastener being closed after protruding through the said holes of the flaps, as shown in FIG. 3 and FIG. 6.

On the interior surface of central panel 11 and the middle panel 12, is preformed or laminated a thin and narrow strip of cardboard or plastic material to form a frame-like raised border as indicated at 35. To facilitate the folding of the panels, the frame 35 is interupted along the folding line 13, between the panels, as shown in FIG. 1.

Within the space so framed by the strip 35 on the interior surface of panels 11 and 12, is the puzzle game 36 made of a number of die cut components like any ordinary puzzle, made of thin material of the same thickness as the frame 35. The die cut pieces of the puzzle 35 are stored in the pocket 25 of the end panel 14 to be removed and installed within the frame each time the game is to be used, as shown in FIG. 1.

Further, on the interior surfaces of the triangular flaps 16, 16a and 17, is printed the text of a story generally relating to the picture puzzle, as indicated at 37, 37a and 37b.

Figure 5:
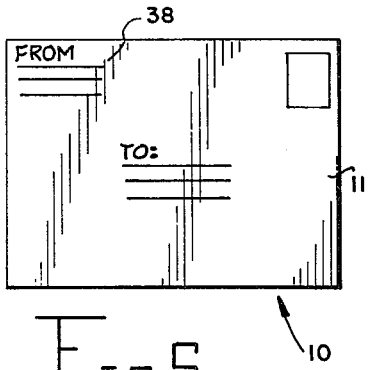
FIG. 5 is a plan view of the first embodiment of my invention in folded position.

The exterior surface 38 of the central panel 11 is printed like any ordinary post-card with the words "from" and "to", lines for addresses, a rectangle marking the location for the stamps and possible advertising, as shown in FIG. 2 and FIG. 5.

On the exterior surface, the middle panel 12, is printed the text of greetings according to the occasion, such as birthday, get well wishes, Christmas, etc., and on the exterior surfaces, the triangular flaps 16, 16a and 17 are printed the description, instructions, contents and pictorial view of the interior puzzle or game, as shown in FIGS. 2 and 6.

It is obvious that many types of games, either for amusement or educational purposes, other than puzzles, can be incorporated within the features of present invention, such as competition cars or horse race games, chess, checkers, stickers, dressing dolls, flash cards and educational games, story or coloring books, advertising or promotional material, etc.

Figure 7:
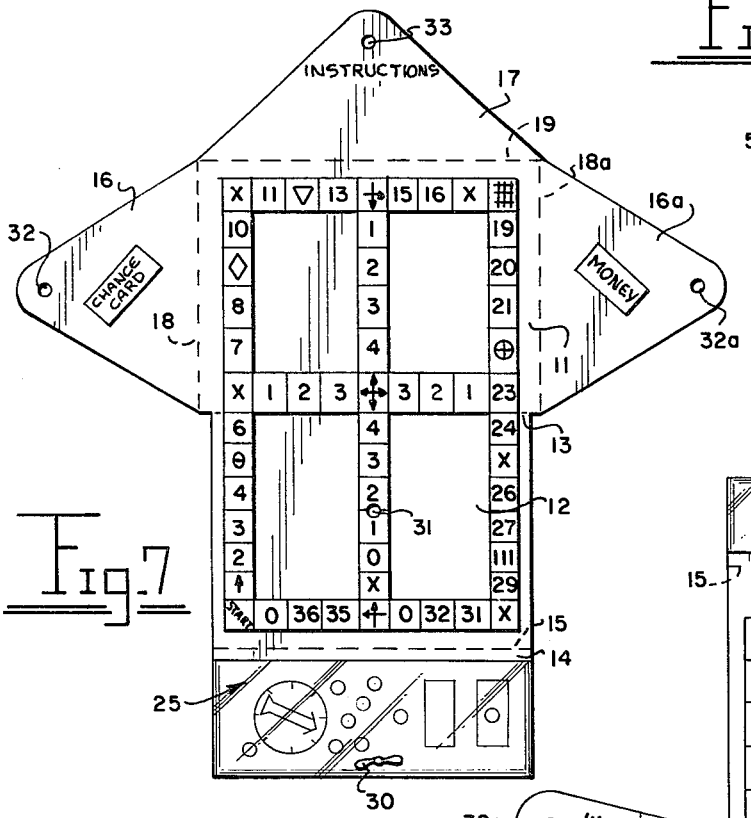
FIG. 7 is the plan view of another embodiment of my invention.

Such a variation comprising a board-game being played with components such as fake-money, dice, chance cards, etc. is illustrated in FIG. 7 with the components stored in the pocket 25 of the panel 14.

Figure 9:
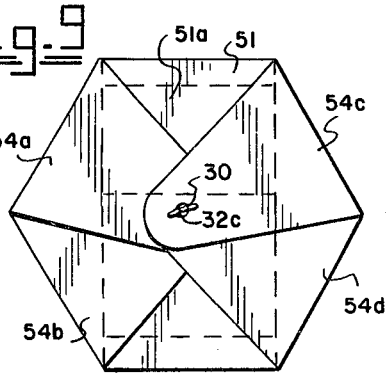
FIG. 9 is the back plan view of the embodiment of FIG. 8 in folded position.
Figure 8:
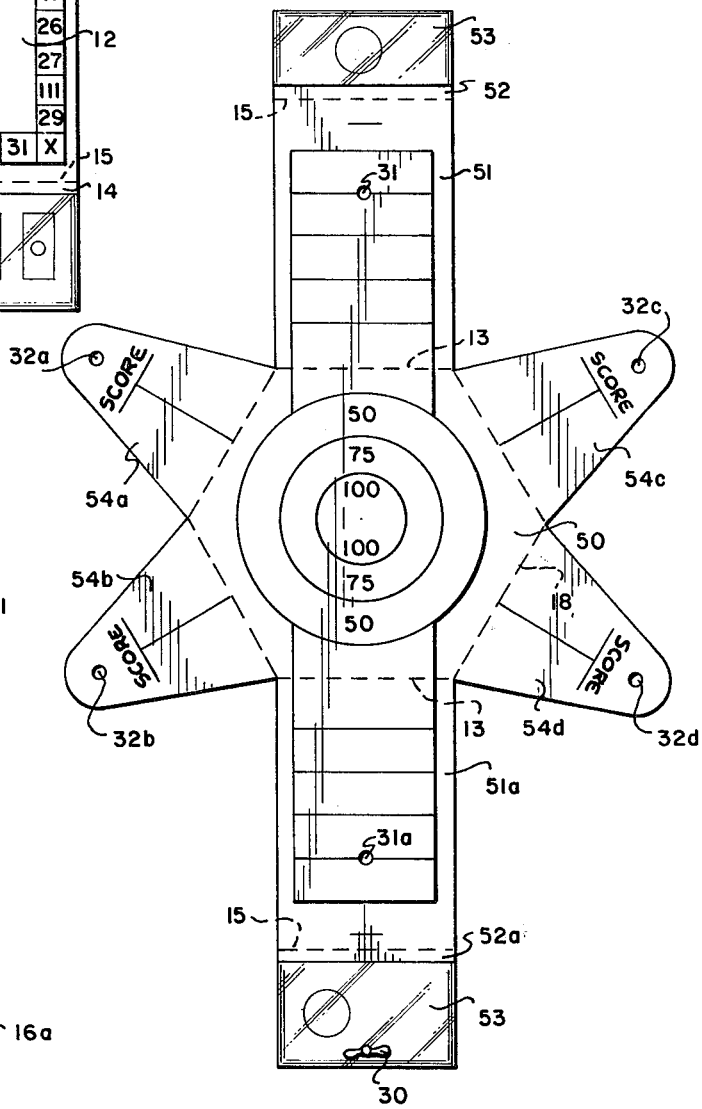
FIG. 8 is the plan view of yet another embodiment of my invention.

It is also understood that cards of my invention can be made, when in folded condition, in a variety of shapes such as triangular, hexagonal, round, etc., to accomodate various games, having panels and flaps of various geometrical shapes. Such a variation illustrated in FIGS. 8 and 9 represents a targetgame board for two or four players, having an hexagonal central panel 50, two middle panels 51 and **51*a*, two end pockets panels 52 and 52*a* with the respective pockets 53 and 53*a*, and four sides triangular flaps 54*a*, 54*b*, 54*c* and 54*d***, the card being folded and closed in the same manner herein described.

While I have described and illustrated the most representative embodyments of my invention, it is to be understood that this invention should not be limited to the constructions disclosed herein, and I reserve the right to all changes, modifications and variations within the scope of the invention as defined in the appended claims.

We claim:

1. A foldable novelty card forming in combination; a flat enclosure formed of a single piece of sheet material subdivided into foldable sections, at least one of said sections making a pocket within the enclosure, at least one of said section having on the interior surface a raised border forming a frame, said frame fillable with component pieces of a puzzle or other game, said component pieces being storable within the said pocket of said panel section, and means on one of said sections to secure said overlapped panels and flaps in folded relation;

a. said section forming foldable panels and flaps, said panels and flaps being foldable and overlaping to make a flat enclosure, said panels and flaps separated from each other by foldable lines;

b. a centrally located section forming a central panel, said panel having fold lines at its edges separating said panel from adjacent sections;

c. a rectangular section forming a middle panel, said middle panel being slightly smaller in width and hight than the said central panel, said middle panel being adjacent and extending outwardly from the said centrally located panel, and separated from said central panel by a fold line, said middle panel having a small hole on its surface located at a point overlaping the geometrical center point of the central panel when said panels are in folded condition;

d. a rectangular section forming an end panel extending outwardly from the said middle panel opposite the said centrally located panel, said end panel separated from the middle panel by a fold line, said end panel being of the same width as the said middle panel but smaller in hight, a piece of clear plastic or similar material preformed, glued or laminated to the edges of said end panel to form a pocket over and comprising the said end panel, said pocket having the opening parallel to the said fold line separating the said middle and end panels, said end panel comprising said pocket foldable over the said middle panel along the said fold line, said end panel and said middle panels foldable as a unit over the said central panel;

e. a fastening or closure device of the metal butterfly type or similar, securely fastened to the said clear piece of plastic forming the top of said pocket of the said end panel, said closure device fastened to the said pocket at a point overlaping the said hole of the said middle panel and the said geometrical center point of said central panel when said panels are in folded condition;

f. triangular flaps extending outwardly from each side of said central panel, separated from said central panel by adjacent folding lines, said flaps foldable over the said central panel along adjacent fold lines, the apex of said foldable flaps overlaping each other over the said central panel, each of said flaps provided with a hole near the respective apex, said holes overlaping above said geometrical center point for said central panel when in folded condition;

g. a game such as puzzle or any other game printed on the interior surfaces of said central and middle panels, said printed game being surrounded by a thin and narrow piece of material glued within the edges of said central and middle panels, said frame being interrupted at the fold line between the said panels to permit folding, the component pieces to play or to complete the puzzle or game stored in said pocket, when said panels are in folded position;

h. panels and flaps sections extending outwardly from said central panel separated by folding lines, said panels and flaps folding in sequence over the said central panel, said end pocket panel folding over the said middle panel said end and middle panels folding as a unit over the said central panel, said flaps folding over the folded middle and end panels, the open wings of said butterfly closure device protruding through the overlaped holes of said panels and flaps, whreby flattening the saised wings of said fastener device said panels and flaps are being held in folded position forming a flat container, said container enclosing said game and game components.

2. The self forming card device as recited in claim 1, said foldable card device making in combination a flat enclosure, comprising a flat sheet of material subdivided in sections forming foldable panels and flaps divided by folding lines, said flat sheet of material comprising a central section panel of rectangular, hexagonal or other designed shaped perimeter, said central panel having printed on the interior surface portions of a puzzle or game and on the exterior surface printed the mailing addresses panel of a post-card, middle panels extending outwardly on one more directions, said middle panels being smaller in width and hight than said central panel and foldable over said central panel along adjacent fold lines, said middle panels having printed on the interior surfaces portions of a puzzle or game and on the exterior surfaces a suitable greeting card text, end panels extending outwardly from said middle panels and separated from said middle panels by folding lines, said end panels having on the interior surface pockets for the storage of component pieces to complete or play said puzzle or game, said end panels having printed on the exterior surfaces instructions and texts relating to the said game, flaps extending outwardly from the sides of said central panel and separated from said central panel by adjacent folding lines, said flaps having printed on the interior surfaces portions of game or puzzle or related text and on the exterior surfaces having printed advertising text relating the device, all said panels and flaps folding inwardly in sequence over the central panel, at least one of the said panels or flaps having means to held in folded container position said panel and flap sections.

* * * * *